US008472841B2

(12) United States Patent
Ikebata

(10) Patent No.: US 8,472,841 B2
(45) Date of Patent: Jun. 25, 2013

(54) PHOTOCONDUCTOR DRUM SUPPORT STRUCTURE, IMAGE FORMING APPARATUS, AND METHOD OF MANUFACTURE FOR PHOTOCONDUCTOR DRUM SUPPORT STRUCTURE

(75) Inventor: Yoshiaki Ikebata, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 333 days.

(21) Appl. No.: 13/039,398

(22) Filed: Mar. 3, 2011

(65) Prior Publication Data

US 2011/0229199 A1 Sep. 22, 2011

(30) Foreign Application Priority Data

Mar. 17, 2010 (JP) ..... 2010-060242

(51) Int. Cl.
*G03G 15/00* (2006.01)

(52) U.S. Cl.
USPC ..... 399/117; 399/167

(58) Field of Classification Search
USPC ..... 399/117, 167
See application file for complete search history.

(56) References Cited

U.S. PATENT DOCUMENTS

| | | | | |
|---|---|---|---|---|
| 5,402,207 | A * | 3/1995 | Michlin | 399/117 |
| 5,583,618 | A * | 12/1996 | Takeuchi et al. | 399/111 |
| 7,110,693 | B1 * | 9/2006 | Michlin et al. | 399/90 |
| 7,194,228 | B2 * | 3/2007 | Arimitsu et al. | 399/167 |
| 7,266,326 | B2 * | 9/2007 | Karakama et al. | 399/109 |
| 7,302,205 | B2 * | 11/2007 | Shintani et al. | 399/111 |
| 2006/0034635 | A1 * | 2/2006 | Itabashi et al. | 399/170 |
| 2006/0045568 | A1 * | 3/2006 | Kishi et al. | 399/111 |
| 2006/0051131 | A1 * | 3/2006 | Takigawa | 399/159 |
| 2006/0204275 | A1 * | 9/2006 | Patton et al. | 399/110 |
| 2006/0245786 | A1 * | 11/2006 | Suzuki | 399/111 |
| 2006/0291904 | A1 * | 12/2006 | Okabe | 399/159 |
| 2007/0003321 | A1 * | 1/2007 | Hara et al. | 399/167 |
| 2007/0009286 | A1 * | 1/2007 | Bryant et al. | 399/117 |
| 2007/0059038 | A1 * | 3/2007 | Shiraki | 399/119 |
| 2007/0110478 | A1 * | 5/2007 | Numagami et al. | 399/167 |
| 2007/0122188 | A1 * | 5/2007 | Igarashi | 399/119 |
| 2007/0189805 | A1 * | 8/2007 | Takigawa | 399/111 |
| 2007/0253729 | A1 * | 11/2007 | Takagi | 399/117 |
| 2008/0181663 | A1 * | 7/2008 | Okabe | 399/159 |
| 2010/0135697 | A1 * | 6/2010 | Hashimoto | 399/117 |
| 2011/0038649 | A1 * | 2/2011 | Miyabe et al. | 399/119 |
| 2011/0182627 | A1 * | 7/2011 | Shiraki et al. | 399/279 |
| 2012/0201560 | A1 * | 8/2012 | Nichols et al. | 399/75 |

FOREIGN PATENT DOCUMENTS

JP 7-325530 A 12/1995

* cited by examiner

*Primary Examiner* — Walter L Lindsay, Jr.
*Assistant Examiner* — David Bolduc

(57) ABSTRACT

A photoconductor drum support structure includes a photoconductor drum that is supported to rotate about a rotation axis; a drum shaft that passes through the photoconductor drum, and is disposed along a rotation axis; a notch formed on the first end in the rotation axis direction of the drum shaft; a drum frame that retains the photoconductor drum to rotate, the drum frame including an opening that is formed on the first end in the rotation axis direction on the drum frame, and enables insertion of the first end of the drum shaft, an engaging portion that is engaged with the notch formed on the drum shaft inserted into the opening, and that regulates displacement of the drum shaft towards the second end.

11 Claims, 9 Drawing Sheets

PHOTOCONDUCTOR DRUM SUPPORT STRUCTURE, IMAGE FORMING APPARATUS, AND METHOD OF MANUFACTURE FOR PHOTOCONDUCTOR DRUM SUPPORT STRUCTURE

This application is based on and claims the benefit of priority from Japanese Patent Application No. 2010-060242, filed on 17 Mar. 2010, the content of which is incorporated herein by reference.

BACKGROUND OF THE INVENTION

1. Field of the Invention

The present invention relates to a support structure for a photoconductor drum onto a drum frame, and the present invention also relates to an image forming apparatus such as a copier or a printer that is provided with the support structure.

2. Related Art

A photoconductor drum in an image forming apparatus such as a copier, a printer or the like is uniformly charged by a charging apparatus, and exposed and scanned by an optical scanning apparatus to thereby form an electrostatic latent image on a drum surface according to image information. The electrostatic latent image is developed by a developing apparatus using toner as a developer, and visualized as a toner image. The toner image is transferred onto paper by a transfer apparatus and fixed onto the paper by application of heat and pressure by a fixing apparatus. A series of image forming operations in the image forming apparatus is completed by discharge of the paper with the toner image fixed thereto out of the apparatus.

However, the photoconductor drum is rotatably supported on the drum frame by a drum shaft that passes through the photoconductor drum. Therefore, a support structure has been proposed in which the photoconductor drum and the drum shaft are integrally assembled and are configured to be simply attached to and detached from the drum frame (photoconductor support housing). More specifically, a support structure has been proposed in which openings that enable sideward fitting of the photoconductor shaft bearing member are respectively formed in a side wall of the drum frame, and an aperture is provided that enables the drum shaft to pass through one of the openings. Operational personnel mount the drum shaft in this support structure through the aperture, and fit the photoconductor shaft bearing member from the side into the opening to thereby support the drum shaft in the drum frame.

However, although the proposed photoconductor drum support structure enables an improvement in assembly characteristics, the structure has a complicated configuration, and may require high accuracy in relation to the photoconductor shaft bearing member. Furthermore, the proposed photoconductor shaft bearing member is associated with an increase in the number of required operations or components and therefore results in cost increases.

SUMMARY OF THE INVENTION

The present invention has the object of providing a support structure for a photoconductor drum that ensures support of a photoconductor drum with a simple structure.

The present invention has the further object of providing an image forming apparatus provided with the support structure for the photoconductor drum.

The present invention has yet the further object of providing a method of manufacturing a support structure for the photoconductor drum.

The present invention relates to a photoconductor drum support structure comprising a photoconductor drum that is supported to rotate about a rotation axis;

a drum shaft that passes through the photoconductor drum, and is disposed along a rotation axis;

a first drum flange that is assembled onto a first end side in the rotation axis direction of the photoconductor drum;

a second drum flange that is assembled onto a second end in the rotation axis direction of the photoconductor drum, and has a fitted portion formed on the second end;

a notch formed on the first end in the rotation axis direction of the drum shaft;

a drum frame that retains the photoconductor drum to rotate, the drum frame including an opening that is formed on the first end in the rotation axis direction on the drum frame, and enables insertion of the first end of the drum shaft, an engaging portion that is engaged with the notch formed on the drum shaft inserted into the opening, and that regulates displacement of the drum shaft towards the second end, and a second end bearing portion that is formed on the second end in the rotation axis direction of the drum frame, and enables insertion of the second end portion of the drum shaft;

a drum gear that is inserted into the second end bearing portion, or that is inserted into the second end that projects to an outer side from the second end bearing portion and is supported to rotate on the second end bearing portion, the drum gear including a fitting portion that fits into the fitted portion on the second drum flange; and a detachment prevention member that is mounted on an outer side of the rotation axis of the drum gear on the drum shaft, and that regulates displacement towards an outer side of the rotation axis of the drum shaft.

The present invention relates to an image forming apparatus comprising a photoconductor drum support structure, the photoconductor drum support structure including a photoconductor drum that is supported to rotate about a rotation axis;

a drum shaft that passes through the photoconductor drum, and is disposed along a rotation axis;

a first drum flange that is assembled onto a first end in the rotation axis direction of the photoconductor drum;

a second drum flange that is assembled onto a second end in the rotation axis direction of the photoconductor drum, and has a fitted portion formed on the second end;

a notch formed on the first end in the rotation axis direction of the drum shaft;

a drum frame that retains the photoconductor drum to rotate, the drum frame including an opening that is formed on the first end in the rotation axis direction on the drum frame, and enables insertion of the first end of the drum shaft, an engaging portion that is engaged with the notch formed on the drum shaft inserted into the opening, and that regulates displacement of the drum shaft towards the second end, and a second end bearing portion that is formed on the second end in the rotation axis direction of the drum frame, and enables insertion of the second end portion of the drum shaft;

a drum gear that is inserted into the second end bearing portion, or that is inserted into the second end that projects to an outer side from the second end bearing portion and is supported to rotate on the second end bearing portion, the drum gear including a fitting portion that fits into the fitted portion on the second drum flange; and a detachment prevention member that is mounted on an outer side of the rotation axis of the drum gear on the drum shaft, and that regulates displacement towards an outer side of the rotation axis of the drum shaft.

The present invention also relates to a method for manufacturing a photoconductor drum support structure, the photoconductor drum support structure including a photoconductor drum that is supported to rotate about a rotation axis;

a drum shaft that passes through the photoconductor drum, and is disposed along a rotation axis;

a first drum flange that is assembled onto a first end in the rotation axis direction of the photoconductor drum;

a second drum flange that is assembled onto a second end in the rotation axis direction of the photoconductor drum, and has a fitted portion formed on the second end;

a notch formed on the first end in the rotation axis direction of the drum shaft;

a drum frame that retains the photoconductor drum to rotate, the drum frame including an opening that is formed on the first end in the rotation axis direction on the drum frame, and enables insertion of the first end of the drum shaft, an engaging portion that is engaged with the notch formed on the drum shaft inserted into the opening, and that regulates displacement of the drum shaft towards the second end, and a second end bearing portion that is formed on the second end in the rotation axis direction of the drum frame, and enables insertion of the second end portion of the drum shaft;

a drum gear that is inserted into the second end bearing portion, or that is inserted into the second end that projects to an outer side from the second end bearing portion and is supported to rotate on the second end bearing portion, the drum gear including a fitting portion that fits into the fitted portion on the second drum flange; and a detachment prevention member that is mounted on an outer side of the rotation axis of the drum gear on the drum shaft, and that regulates displacement towards an outer side of the rotation axis of the drum shaft, the method comprising the steps of:

inserting the first end of the drum shaft into the opening of the drum frame;

inserting the second end of the drum shaft into the second end bearing portion;

engaging the notch of the drum shaft with the engaging portion of the drum frame, and positionally determining the drum shaft in the direction of the rotation axis;

inserting the drum gear from the outer side of the drum frame into the axial second end of the drum shaft;

fitting the fitting portion on the drum gear into the fitted portion on the second drum flange, the second drum flange assembled onto the second end in the rotation axis direction of the photoconductor drum; and mounting the detachment prevention member onto the outer side in the rotation axis direction of the drum gear in the drum shaft.

The present invention provides a support structure for a photoconductor drum that ensures support of the photoconductor drum with a simple structure.

The present invention provides an image forming apparatus provided with a support structure for the photoconductor drum.

The present invention provides a method of manufacturing the support structure for the photoconductor drum.

DETAILED DESCRIPTION OF THE INVENTION

The aspect of the embodiments of the present invention will be described below making reference to the attached figures.

[Image Forming Apparatus]

Figure 1:
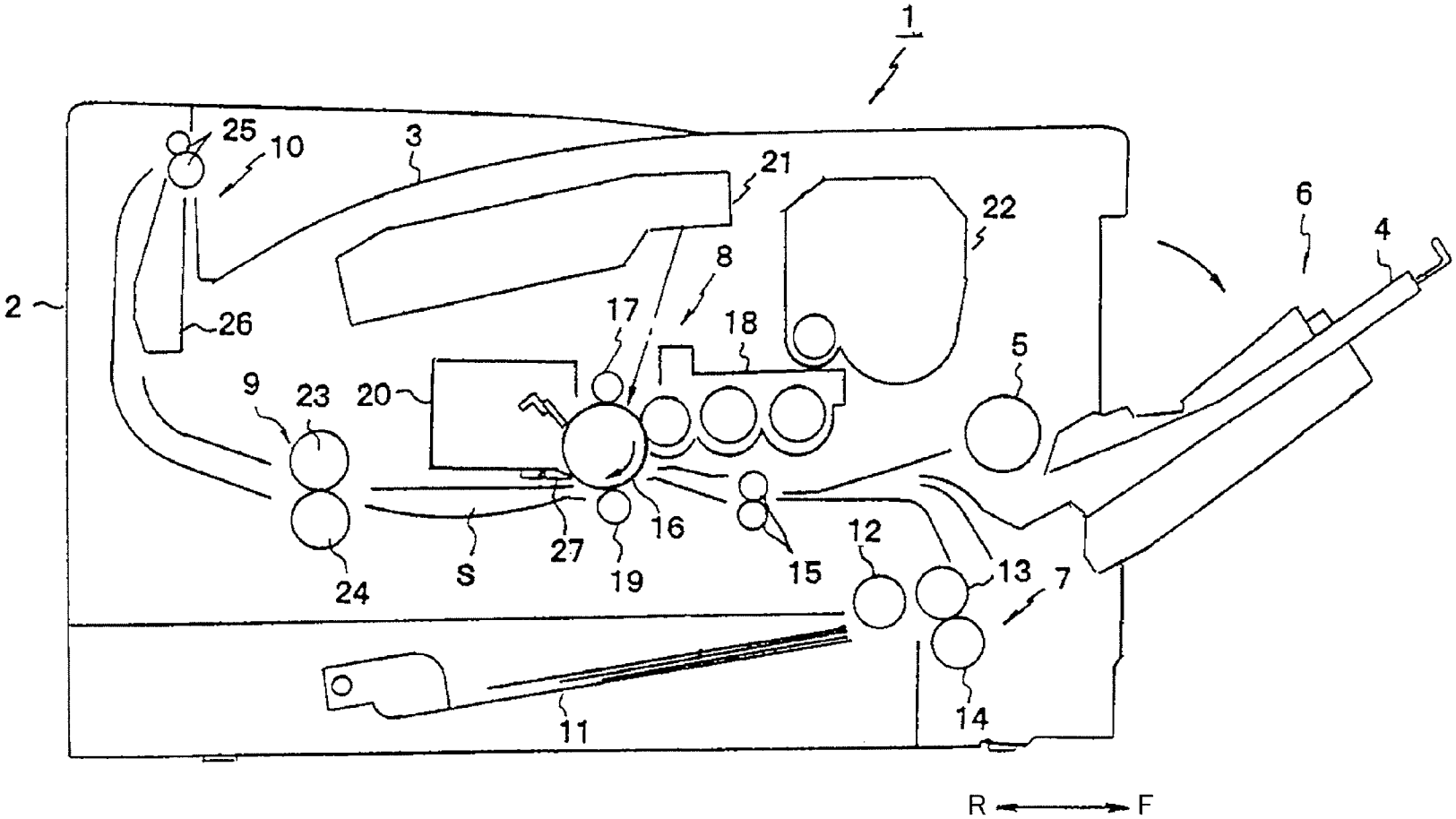
FIG. 1 is a side sectional view of the image forming apparatus (laser printer) according to the present invention.

FIG. 1 is a side sectional view of a laser printer as an example of an image forming apparatus according to the present invention. The laser printer 1 shown in the figure includes an inclined concave discharge tray 3 provided at a central portion of an upper surface of the rectangular box-shaped printer main body (housing) 2. A manual feed tray 4 that can be opened and closed is provided on an upper portion of the front surface (the right side of FIG. 1 is the front surface) of the printer main body 2. The manual feed tray 4 and a manual sheet feed roller 5 that is rotatably provided further within the printer main body 2 configure a manual sheet feed unit 6.

The laser printer 1 forms an image on paper based on image data sent from a terminal or the like (not shown) while conveying paper, which is the recording medium, along a conveyance path S provided in the printer main body 2. The conveyance path S forms an L shape when viewed from the side, and extends to the discharge tray 3.

Furthermore, the laser printer 1 includes a cassette sheet feed unit 7 provided on a lower portion of the printer main body 2, an image forming unit 8 provided in substantially a central portion in the printer main body above the cassette sheet feed unit 7, a fixing apparatus 9 disposed behind the image forming unit 8, and a concave paper discharge unit 10 provided on an upper surface of the printer main body 2 above the fixing apparatus 9.

The cassette sheet feed unit 7 includes a rectangular tray-shaped sheet feed cassette 11 that includes an upper surface in an open configuration and that stacks and stores a plurality of paper sheets, a pick roller 12 that removes individual sheets from the sheet feed cassette 11, and a feed roller 13 and retard roller 14 that separate the individually removed sheets and convey each sheet to the conveyance path S.

A registration roller pair 15 is provided in the conveyance path S to apply a temporarily stand-by configuration to a supplied sheet and then supply the sheet to the image forming unit 8 at a predetermined timing.

The image forming unit 8 forms an image in accordance with the image data on the each sheet of paper supplied from the manual sheet feed unit 6 or the cassette sheet feed unit 7. The image forming unit 8 includes a photoconductor drum 16 that acts as an image supporting body rotatably provided in substantially a center portion of the printer main body 2, a charging roller 17 disposed on a periphery thereof, a developing apparatus 18 acting as a developing means, a transfer roller 19 acting as a transfer means, and a cleaning apparatus 20, an optical scanning apparatus (LSU) 21 disposed above these components, and a toner hopper 22 that contains toner to be used for replenishing.

In addition, the fixing apparatus 9 fixes the toner image, transferred onto paper in the image forming unit 8, onto the paper sheet. The fixing apparatus 9 includes a fixing roller 23 and a pressure roller 24 that are pressed into contact and rotate. A heating means such as a heater or the like is provided in the fixing roller 23. The pressure roller 24 applies a fixed pressure to the fixing roller 23 by the action of a biasing means such as a spring or the like. A fixing nip is formed between these two components.

The paper discharge unit 10 discharges a paper sheet with a toner image fixed thereto by the fixing apparatus 9 out of the printer main body 2. The paper discharge unit 10 includes an upper and lower pair of paper discharge rollers 25 provided on an end of the conveyance path S, a plurality of vertical rib-shaped conveyance guide ribs 26 that guide paper conveyed from the fixing apparatus 9 along the conveyance path S to the pair of paper discharge rollers 25, and the discharge tray 3 that stacks sheets of paper discharged out of the printer main body 2.

The image forming operation of the laser printer 1 that has the above configuration will be described below.

For example, when a print start signal is sent from a terminal such as a personal computer or the like to the laser printer 1, the photoconductor drum 16 in the image forming unit 8 is rotated at a predetermined processing speed in the direction of the arrow down in FIG. 1 (clockwise direction) by a drive means (not shown). The charging roller 17 applies a uniform charge having a predetermined potential to the drum surface.

An optical scanning apparatus 2 outputs laser light based on the image data sent from the terminal to thereby illuminate the photoconductor drum 16. In this manner, an electrostatic latent image is formed in accordance with the image data on the photoconductor drum 16.

The electrostatic latent image formed on the photoconductor drum 16 is developed by the developing apparatus 18 using toner as a developer, and is visualized as a toner image.

However, when supplying paper from the cassette, paper that is stored in the sheet feed cassette 11 of the cassette sheet feed unit 7 is individually picked up in order from the uppermost sheet by the pick roller 12, and separated into individual sheets by the feed roller 13 and the retard roller 14 for supply to the registration roller pair 15. After the paper is retained temporarily in a standby state by the registration roller pair 15, the paper is supplied to the image forming unit 8 at a predetermined timing that is synchronized with the toner image on the photoconductor drum 16.

A sheet of paper that is supplied to the transfer nip between the photoconductor drum 16 and the transfer roller 19 in the image forming unit 8 is pressed and conveyed by the transfer roller 19 onto the photoconductor drum 16 to thereby transfer the toner image from the photoconductor drum 16 onto the paper surface (transfer surface). The paper sheet having the toner image transferred thereon is conveyed to the fixing apparatus 9. The toner image is fixed to the paper sheet undergoes by heat and pressure in a process of sandwiching and conveying the sheet with the fixing nip of the fixing roller 23 and the pressure roller 24 in the fixing apparatus 9. Residual toner on the surface of the photoconductor drum 16 after transfer of the toner image onto the paper sheet (transfer toner residue) is removed by the cleaning apparatus 20. The surface of the photoconductor drum 16 is cleaned, and thereby prepared for the subsequent image forming operation.

The paper sheet having a toner image fixed to a surface thereof by the fixing apparatus 9 is conveyed up the conveying path S towards the paper discharge unit 10. The paper sheet is guided along the conveyance guide rib 26 towards the paper discharge roller pair 25, and is gripped by the paper discharge roller pair 25 and discharged out of the printer main body 2. The paper sheet is stacked in the discharge tray 3 provided on an upper portion of the printer main body 2.

This completes a series of image forming operations.

When a user executes manual paper supply, paper that is stacked in the manual feed tray 4 of the manual sheet feed unit 6 is supplied to the registration roller pair 15 by the manual sheet feed roller 5. Thereafter, the same processes as described above are executed to form an image on the paper, then the paper with the image formed thereon is stacked in the discharge tray 3 outside of the printer main body 2.

[Photoconductor Drum Support Structure]

Next a support structure of the photoconductor drum 16 will be described with reference to FIG. 2A to FIG. 9.

Figure 2A:
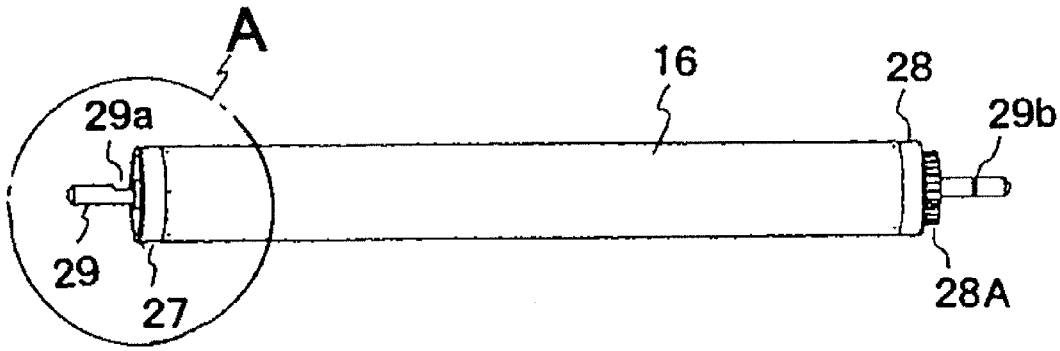
FIG. 2A is a perspective view of a photoconductor drum for the image forming apparatus according to the present invention.
Figure 2B:
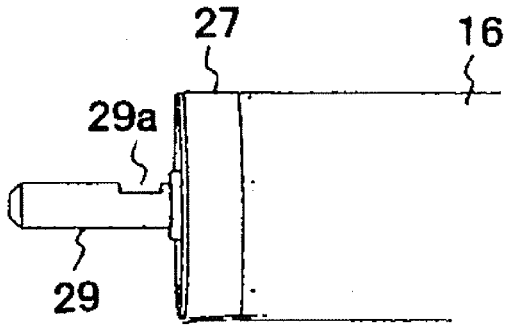
FIG. 2B is a partially enlarged view of region A in FIG. 2A.
Figure 3A:
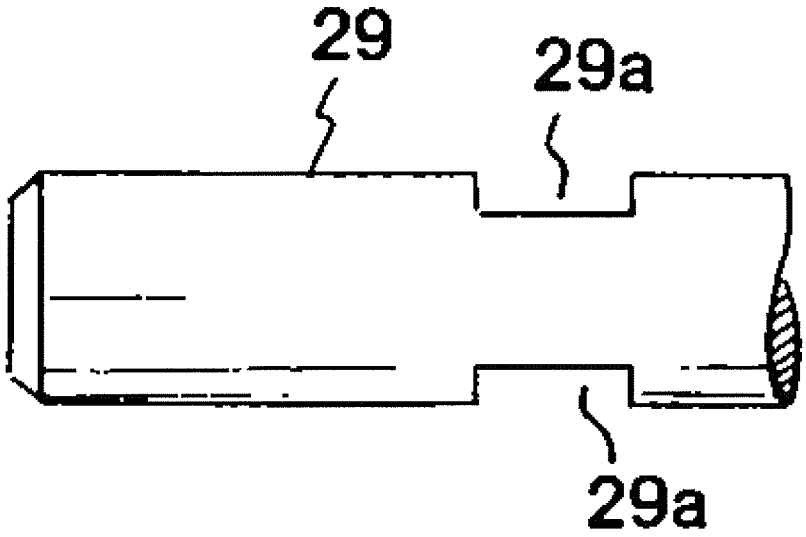
FIG. 3A is a partial front view of variation of a notch of a drum shaft end.
Figure 3B:
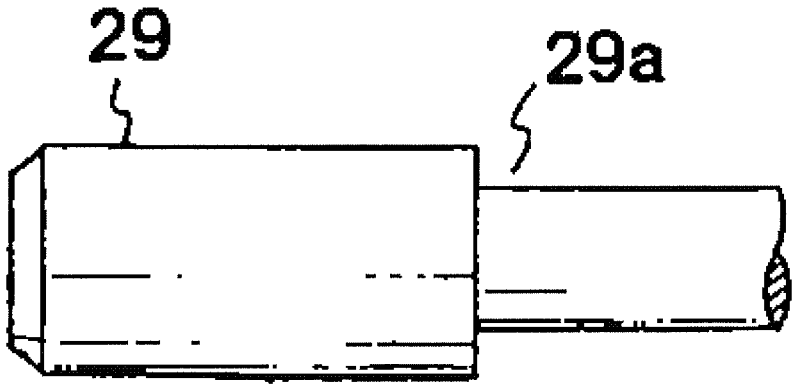
FIG. 3B is a partial front view of variation of the notch of the drum shaft end.
Figure 4B:
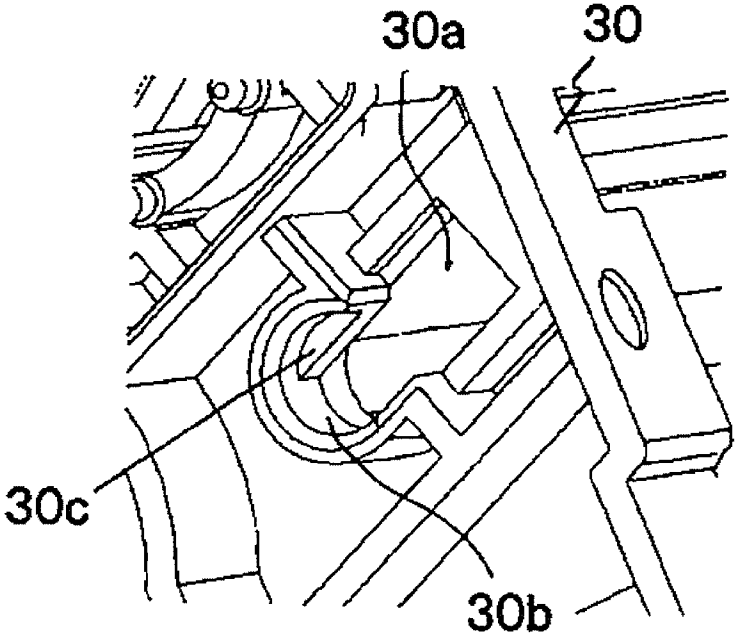
FIG. 4B is a partially enlarged view of region B in FIG. 4A.
Figure 4A:
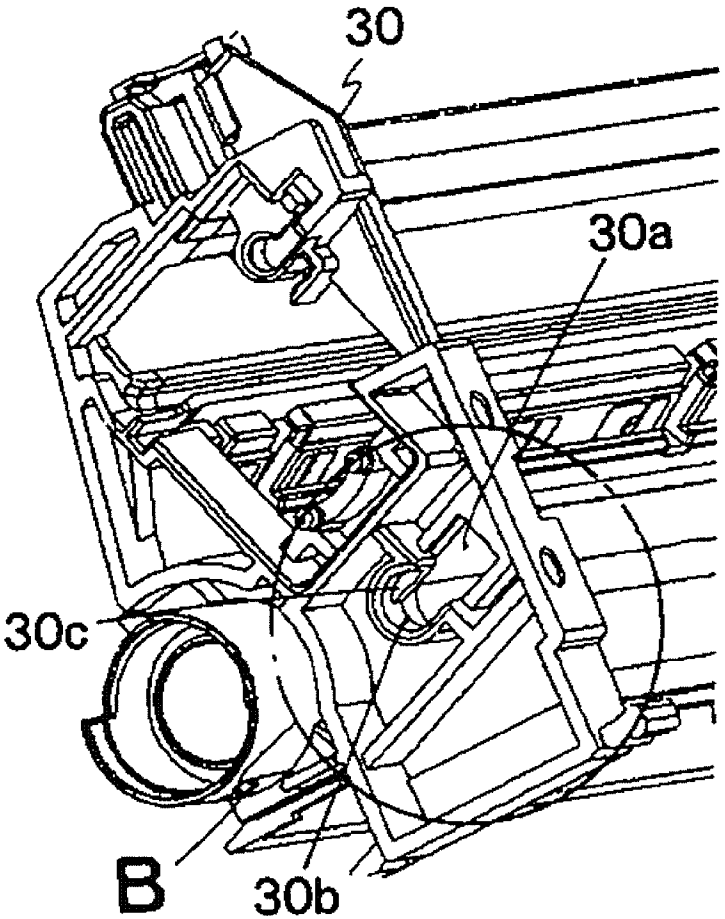
FIG. 4A is a partial perspective view of the drum frame.
Figure 5:
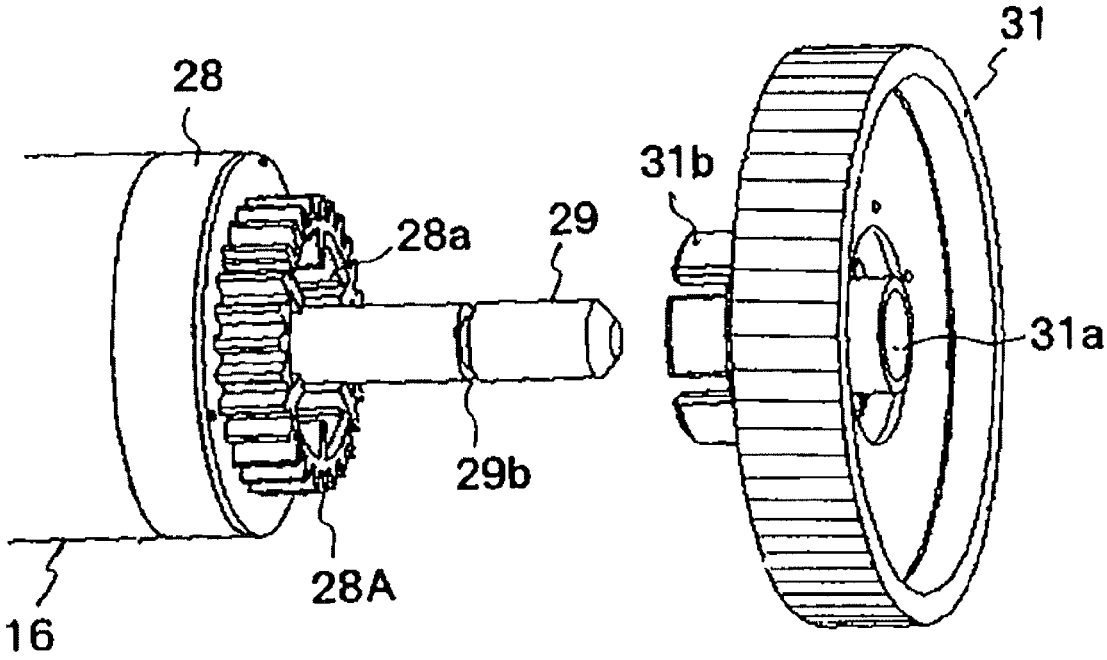
FIG. 5 is a partial perspective view of the drum frame and a drum gear.
Figure 6A:
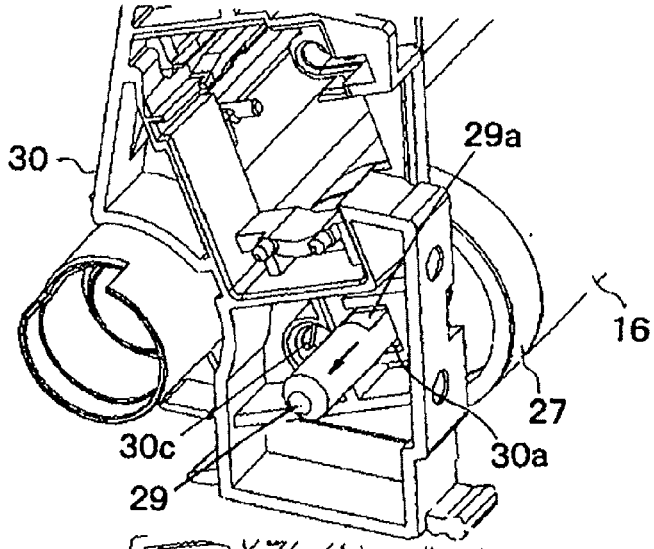
FIG. 6A is a partial perspective view of the order of assembly of the photoconductor drum.
Figure 6B:
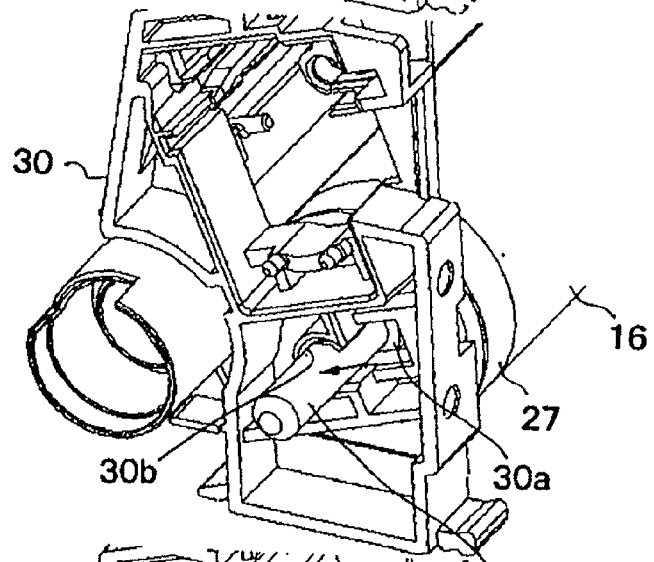
FIG. 6B is a partial perspective view of the order of assembly of the photoconductor drum.
Figure 6C:
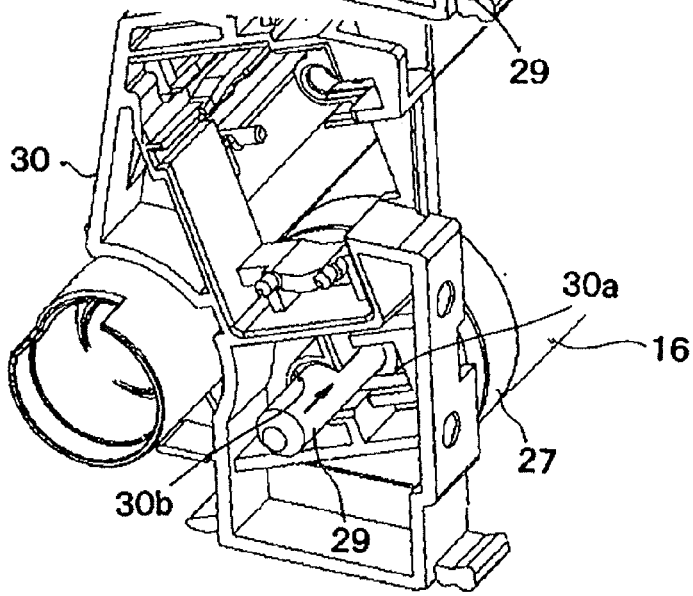
FIG. 6C is a partial perspective view of the order of assembly of the photoconductor drum.
Figure 7:
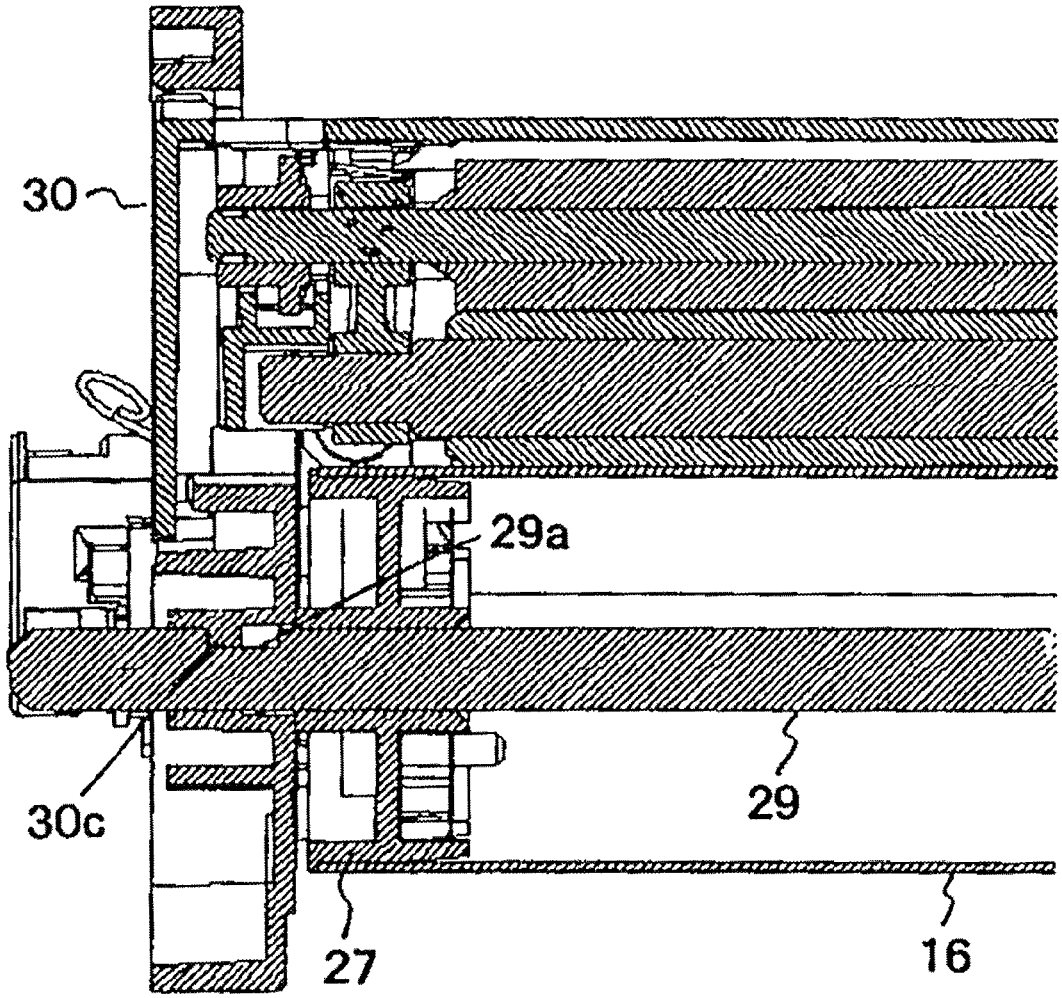
FIG. 7 is a partial front sectional view showing a support structure for an end of the photoconductor drum.
Figure 8A:
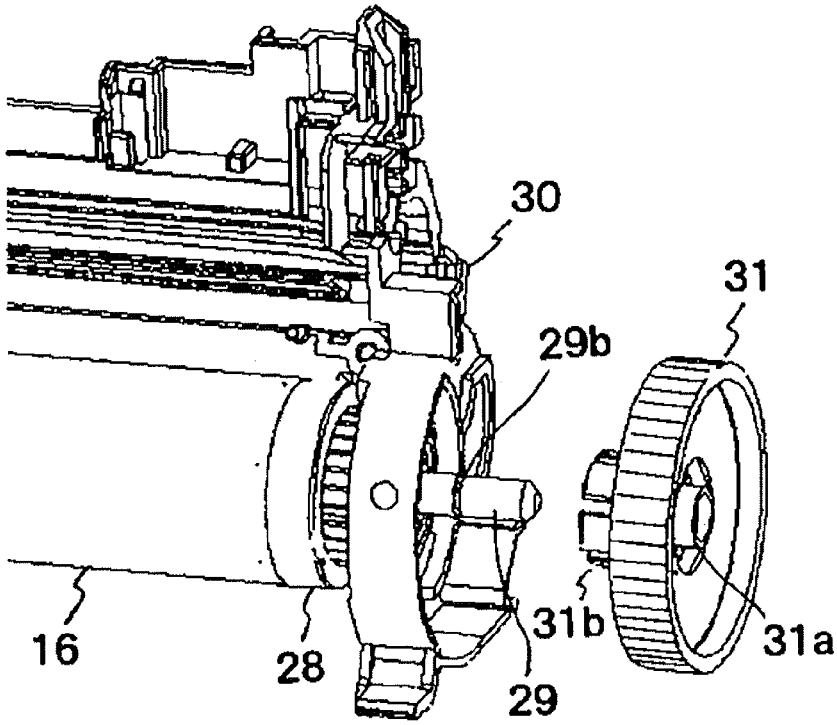
FIG. 8A is a partial perspective view of the order of assembly of the photoconductor drum.
Figure 8B:
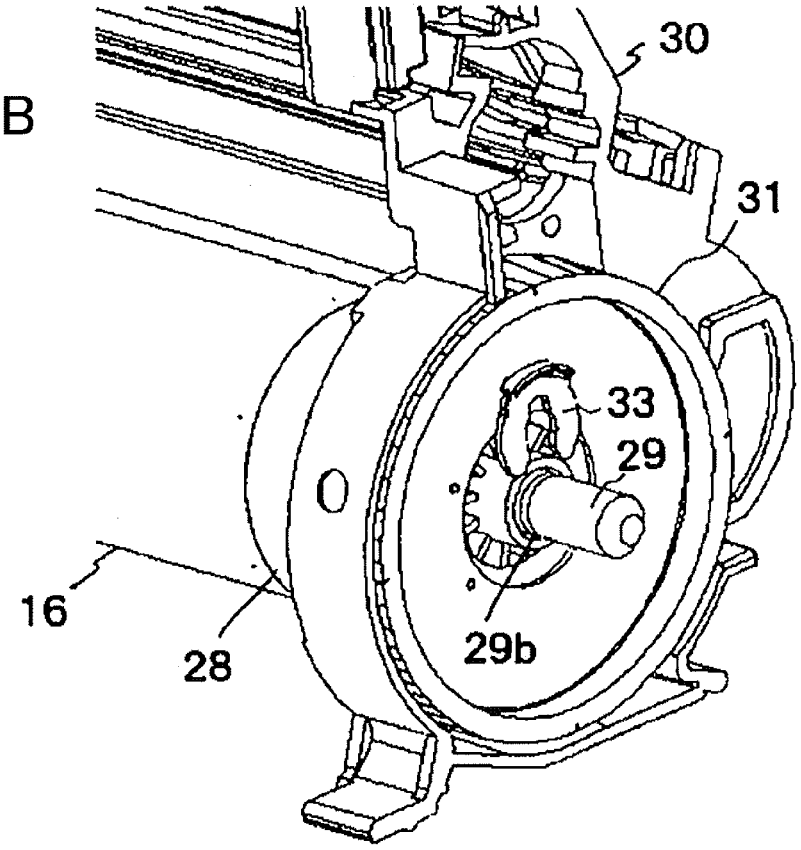
FIG. 8B is a partial perspective view of the order of assembly of the photoconductor drum.
Figure 9:
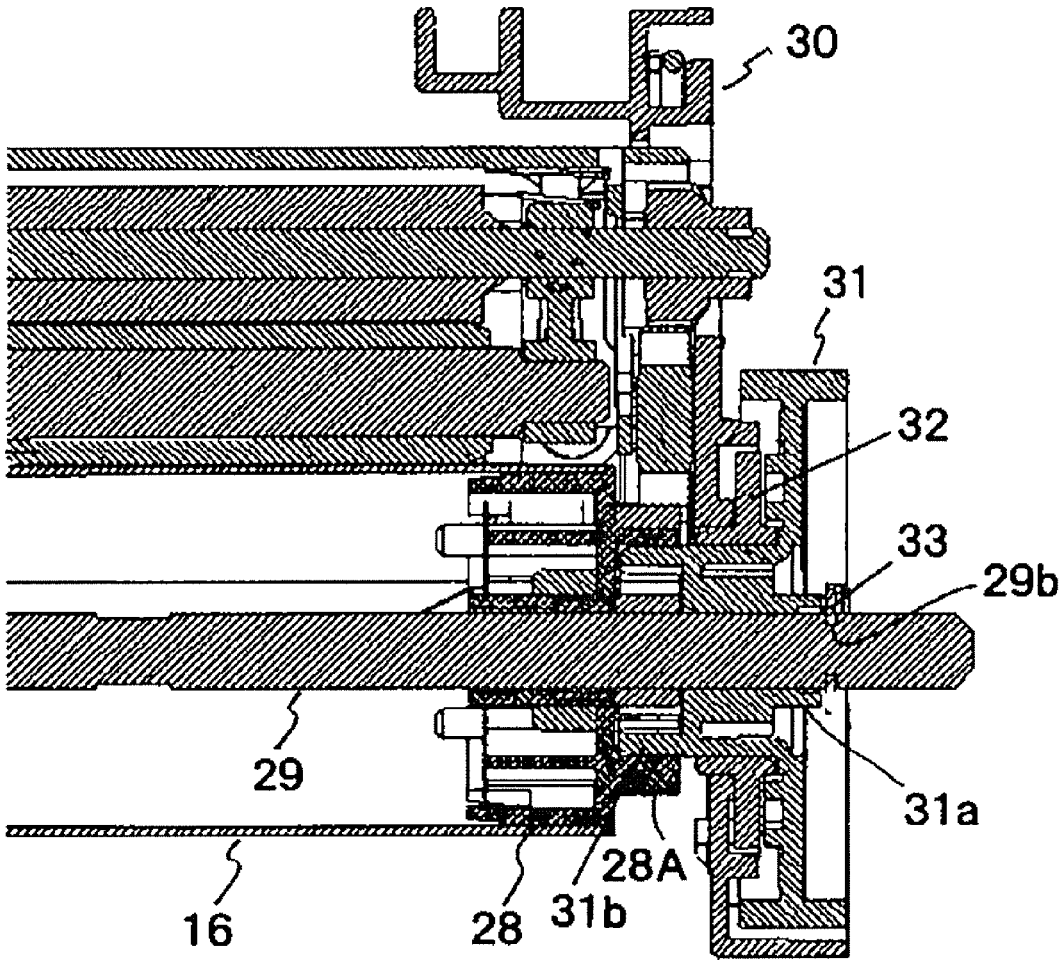
FIG. 9 is a partial front sectional view of a support structure for a second end of the photoconductor drum.

FIG. 2A is a perspective view of a photoconductor drum for the image forming apparatus according to the present invention. FIG. 2B is a partially enlarged view of the region A in FIG. 2A. FIG. 3A is a partial front view of variation of the notch of the drum shaft end. FIG. 3B is a partial front view of variation of the notch of the drum shaft end. FIG. 4A is a partial perspective view of the drum frame. FIG. 4B is a partially enlarged view of the region B in FIG. 4A. FIG. 5 is a partial perspective view of the drum frame and the drum gear. FIG. 6A is a partial perspective view of the order of assembly of the photoconductor drum. FIG. 6B is a partial perspective view of the order of assembly of the photoconductor drum. FIG. 6C is a partial perspective view of the order of assembly of the photoconductor drum. FIG. 7 is a partial front sectional view showing a support structure for an end of the photoconductor drum. FIG. 8A is a partial perspective view of the order of assembly of the photoconductor drum. FIG. 8B is a partial perspective view of the order of assembly of the photoconductor drum. FIG. 9 is a partial front sectional view of a support structure for a second end of the photoconductor drum.

As shown in FIG. 2*a*, a first drum flange 27 and a second drum flange 28 are assembled onto both axial ends of the photoconductor drum 16. The first drum flange 27 is assembled onto the first end in the rotation axis direction which is the direction of extension of the rotation axis described below in the photoconductor drum 16. The second drum flange 28 is assembled onto a second end in the direction of the rotation axis of the photoconductor drum 16. A gear 28A is integrally formed on the second drum flange 28.

A drum shaft 29 passes through the axial center of the photoconductor drum 16. The photoconductor drum 16 rotates about the drum shaft 29 (the center line of the drum shaft 29 is taken to be the rotation axis). In other words, the drum shaft 29 passes through the photoconductor drum 16, and is disposed along the rotation axis.

As shown in detail in FIG. 2B, a flat notch 29*a* having a D-cut shape is formed on an outer periphery of one axial end of the drum shaft 29. The notch 29*a* may be formed in two relative positions (the other side each other) on the outer periphery of the drum shaft 29 as shown in FIG. 3A, or may be formed as a small diameter portion forming a coaxial portion by continuous cutting of the outer peripheral direction as shown in FIG. 3B.

As shown in FIG. 4A and FIG. 4B, the photoconductor drum 16 is rotatably supported on the drum frame 30 as shown in FIG. 4 through the drum shaft 29 that passes through the center of the photoconductor drum 16. An opening 30*a* and a semicircular cylindrical first end bearing portion 30*b* communicating with the opening 30*a* are formed on one end of the drum frame 30. A rib-shaped engaging portion 30*c* is formed on an inner periphery of the first end bearing portion 30*b*. The engaging portion 30*c* engages with the notch 29*a* that is formed on the drum shaft inserted into the opening 30*a*. The engaging portion 30*c* regulates the motion of the drum shaft 29 towards the first end and the second end on the opposite side. The engaging portion 30*c* positionally determines the drum shaft 29 in a direction of rotation.

In addition, as shown in FIG. 5, a circular fitting hole 28*a* is formed on an inner peripheral portion of the gear 28A that is integrally formed on the second drum flange 28 assembled onto an axial end of the photoconductor drum 16. The fitting hole 28*a* is formed on the second end side in the direction of the rotation axis on the second drum flange 28.

A fitting groove 29*b* is formed along the entire periphery of the outer periphery of the end of the drum shaft 29 that protrudes to an outer side of the second drum flange 28. The fitting groove 29*b* is a groove portion on which a detachment prevention member 33 described below is mounted (fitted).

However, although the drum gear 31 is mounted to sandwich the drum frame 30 on the second drum flange 28 as described below, as shown in FIG. 5, a cylindrical boss 31*a* and coupling 31*b* (fitting portion) are formed on a central portion of the drum gear 31. The end of the drum shaft 29 (the other end that is inserted into the second end bearing portion 32, or that is a portion on the other end of the inserted portion, and protrudes to the outer side of the drum frame 30) is inserted into the boss 31*a* of the drum gear 31, and the coupling 31*b* is fitted into the fitting hole 28*a* (fitted portion) formed on an inner peripheral portion of the gear 28A of the second drum flange 28 to thereby enable assembly of the drum gear 31 into the second drum flange 28.

The drum gear 31 is rotatably supported on the second end bearing portion 32.

The detachment prevention member 33 is mounted on the outer side in the rotation axis direction of the drum gear 31 on the drum shaft 29. The detachment prevention member 33 regulates motion towards an outer side in the rotation axis direction of the drum gear 31 (suppresses detachment of the drum gear 31 from the drum shaft 29).

Next, the assembly procedure of the photoconductor drum 16 into the drum frame 30 will be described below making reference to FIG. 6A to FIG. 9. The method of manufacturing a support structure for a photoconductor drum will be described.

When assembling the photoconductor drum 16, as shown in FIG. 6A, operational personnel pass the drum shaft 29 into an axial center portion of the photoconductor drum 16, to thereby provisionally assembly both these components. Then one axial end of the drum shaft 29 is passed into the opening 30*a* of the drum frame 30 from the inner side of the drum frame 30 (the direction of the arrow shown in FIG. 6A).

Operational personnel align the notch 29*a* formed on the drum shaft 29 (refer to FIG. 2A and FIG. 2B) with the engaging portion 30*c* formed on the drum frame 30, and press the drum shaft 29 together with the photoconductor drum 16 in the direction of the arrow shown in FIG. 6B, to thereby fit the engaging portion 30*c* of the drum frame 30 with the notch 29*a*, and insert the drum shaft 29 into the first end bearing portion 30*b* of the drum frame 30. In this manner, the drum shaft 29 is supported by the first end bearing portion 30*b* of the drum frame 30.

Next, as shown in FIG. 6C, the operational personnel place the end face of the notch 29*a* of the drum shaft 9 in abutment with the engaging portion 30*c* of the drum frame 30 as shown by FIG. 7 by sliding the photoconductor drum 16 and the drum shaft 29 in the direction of the arrow in the figure. Thus, the drum shaft 29 can be axially positioned relative to the drum frame 30, and the second end in an axial direction of the drum shaft 29 protrudes to an outer side of the second end of the drum frame 30 as shown in FIG. 8A.

As shown in FIG. 8A, when the second axial end of the drum shaft 29 protrudes to an outer side of the second end of the drum frame 30, the operational personnel press the drum gear 31 towards the drum shaft 29 keeping the coupling 31*b* on an inner side, and thereby pass the end portion of the drum shaft 29 into the boss 31*a*. In this manner, the operational personnel fit the boss 31*a* into the second end bearing portion 32 of the drum frame 30 as shown in FIG. 9, and fit the coupling 31*b* into the fitting hole 28*a* formed on an inner peripheral portion of the gear 28A of the second drum flange 28.

Consequently, mounting is executed between the drum gears 31 on the second drum flange 28 sandwiching the drum frame 30. The drum gear 31 is rotatably supported on the drum frame 30 through the second end bearing portion 32. For this reason, the second axial end of the drum shaft 29 is supported on the drum frame 30 through the drum gear 31 and the second end bearing portion 32. In other words, the photoconductor drum 16 and the drum gear 31 are rotatably supported by the drum frame 30 through the drum shaft 29.

Finally, as shown in FIG. 8B, the operational personnel fix the detachment prevention member 33 such as an E ring, or the like to the fitting groove 29*b* formed on the end protruding to an outer side from the drum gear 31 of the drum shaft 29. In this manner, the photoconductor drum 16 and the drum shaft 29 are positionally determined in an axial direction with reference to the drum frame 30, and are prevented from detaching from the drum shaft 29 of the drum gear 31.

The above procedure enables the photoconductor drum 16 to be rotatably supported on the drum frame 30. However in the present embodiment, the bearing member that is a separate member is not required to support the photoconductor drum 16 onto the drum frame 30, and merely a small detachment prevention member 33 such as an E ring, or the like may be used. As a result, the support structure according to the present embodiment can be simplified thereby ensuring the support of the photoconductor drum 16. In this manner, the support structure according to the present embodiment enables a reduction in the number of processing steps and the number of components, and thereby reduces costs. In addition, since the photoconductor drum 16 is positionally determined by the drum frame 30, positional accuracy is enhanced.

Although an embodiment applying the present invention in relation to a laser printer, and to a support structure for a photoconductor drum provided in such an apparatus has been described above, the present invention may of course be applied in the same manner to another image forming apparatus including a printer, a copier, or the like, or to a support structure for a photoconductor drum provided in such apparatuses.

What is claimed is:

1. A photoconductor drum support structure comprising: a photoconductor drum that is supported to rotate about a rotation axis;

a drum shaft that passes through the photoconductor drum, and is disposed along the rotation axis;

a first drum flange that is assembled onto a first end in the rotation axis direction of the photoconductor drum;

a second drum flange that is assembled onto a second end in the rotation axis direction of the photoconductor drum, and has a fitted portion formed on the second end;

a notch formed on the first end in the rotation axis direction of the drum shaft;

a drum frame that retains the photoconductor drum to rotate, the drum frame including an opening that is formed on the first end in the rotation axis direction on the drum frame, and enables insertion of the first end of the drum shaft, an engaging portion that is engaged with the notch formed on the drum shaft inserted into the opening, and that regulates displacement of the drum shaft towards the second end of the drum frame, and a second end bearing portion that is formed on the second end in the rotation axis direction of the drum frame, and enables insertion of the second end portion of the drum shaft;

a drum gear that is inserted into the second end bearing portion, or that is inserted into the second end of the drum frame that projects to an outer side from the second end bearing portion and is supported to rotate on the second end bearing portion, the drum gear including a fitting portion that fits into the fitted portion on the second drum flange; and a detachment prevention member that is mounted on an outer side of the rotation axis of the drum gear on the drum shaft, and that regulates displacement towards an outer side of the rotation axis of the drum shaft.

2. The photoconductor drum support structure according to claim 1 wherein the drum frame includes a first end bearing portion that is connected to the opening, and the engaging portion is formed on the first end bearing portion.

3. The photoconductor drum support structure according to claim 1 wherein the drum gear is mounted on the second drum flange to sandwich a portion of the drum frame.

4. The photoconductor drum support structure according to claim 1 wherein the drum gear includes a cylindrical boss that is inserted into the second end bearing portion.

5. The photoconductor drum support structure according to claim 1 wherein a groove portion is formed on the whole periphery on the outer peripheral direction of the second end of the drum shaft, the groove portion mounting the detachment prevention portion.

6. An image forming apparatus comprising a photoconductor drum support structure, the photoconductor drum support structure comprising:

a photoconductor drum that is supported to rotate about a rotation axis;

a drum shaft that passes through the photoconductor drum, and is disposed along the rotation axis;

a first drum flange that is assembled onto a first end in the rotation axis direction of the photoconductor drum;

a second drum flange that is assembled onto a second end in the rotation axis direction of the photoconductor drum, and has a fitted portion formed on the second end;

a notch formed on the first end in the rotation axis direction of the drum shaft;

a drum frame that retains the photoconductor drum to rotate, the drum frame including an opening that is formed on the first end in the rotation axis direction on the drum frame, and enables insertion of the first end of the drum shaft, an engaging portion that is engaged with the notch formed on the drum shaft inserted into the opening, and that regulates displacement of the drum shaft towards the second end of the drum frame, and a second end bearing portion that is formed on the second end in the rotation axis direction of the drum frame, and enables insertion of the second end portion of the drum shaft;

a drum gear that is inserted into the second end bearing portion, or that is inserted into the second end of the drum frame that projects to an outer side from the second end bearing portion and is supported to rotate on the second end bearing portion, the drum gear including a fitting portion that fits into the fitted portion on the second drum flange; and a detachment prevention member that is mounted on an outer side of the rotation axis of the drum gear on the drum shaft, and that regulates displacement towards an outer side of the rotation axis of the drum shaft.

7. The image forming apparatus according to claim 6 wherein the drum frame includes a first end bearing portion that is connected to the opening, and the engaging portion is formed on the first end bearing portion.

8. The image forming apparatus according to claim 6 wherein the drum gear is mounted on the second drum flange to sandwich a portion of the drum frame.

9. The image forming apparatus according to claim 6 wherein the drum gear includes a cylindrical boss that is inserted into the second end bearing portion.

10. The image forming apparatus according to claim 6 wherein a groove portion is formed on the whole periphery on the outer peripheral direction of the second end of the drum shaft, the groove portion mounting the detachment prevention portion.

11. A method for manufacturing a photoconductor drum support structure, the photoconductor drum support structure including a photoconductor drum that is supported to rotate about a rotation axis;

a drum shaft that passes through the photoconductor drum, and is disposed along the rotation axis;

a first drum flange that is assembled onto a first end in the rotation axis direction of the photoconductor drum;

a second drum flange that is assembled onto a second end in the rotation axis direction of the photoconductor drum, and has a fitted portion formed on the second end;

a notch formed on the first end in the rotation axis direction of the drum shaft;

a drum frame that retains the photoconductor drum to rotate, the drum frame including an opening that is formed on the first end in the rotation axis direction on the drum frame, and enables insertion of the first end of the drum shaft, an engaging portion that is engaged with the notch formed on the drum shaft inserted into the opening, and that regulates displacement of the drum shaft towards the second end of the drum frame, and a second end bearing portion that is formed on the second end in the rotation axis direction of the drum frame, and enables insertion of the second end portion of the drum shaft;

a drum gear that is inserted into the second end bearing portion, or that is inserted into the second end of the drum frame that projects to an outer side from the second end bearing portion and is supported to rotate on the second end bearing portion, the drum gear including a fitting portion that fits into the fitted portion on the second drum flange; and a detachment prevention member that is mounted on an outer side of the rotation axis of the drum gear on the drum shaft, and that regulates displacement towards an outer side of the rotation axis of the drum shaft, the method comprising the steps of inserting the first end of the drum shaft into the opening of the drum frame;

inserting the second end of the drum shaft into the second end bearing portion;

engaging the notch of the drum shaft with the engaging portion of the drum frame, and positionally determining the drum shaft in the direction of the rotation axis;

inserting the drum gear from the outer side of the drum frame into the axial second end of the drum shaft;

fitting the fitting portion on the drum gear into the fitted portion on the second drum flange, the second drum flange assembled onto the second end in the rotation axis direction of the photoconductor drum; and mounting the detachment prevention member onto the outer side in the rotation axis direction of the drum gear in the drum shaft.

* * * * *